US008528623B2

(12) United States Patent
Roberts

(10) Patent No.: US 8,528,623 B2
(45) Date of Patent: Sep. 10, 2013

(54) RETRACTABLE SCREEN

(75) Inventor: Anthony Gerard Roberts, Burleigh (AU)

(73) Assignee: Freedom Screens of Australia Pty Ltd, Queensland (AU)

( * ) Notice: Subject to any disclaimer, the term of this patent is extended or adjusted under 35 U.S.C. 154(b) by 125 days.

(21) Appl. No.: 12/948,929

(22) Filed: Nov. 18, 2010

(65) Prior Publication Data

US 2011/0114272 A1 May 19, 2011

(51) Int. Cl.
*E06B 9/56* (2006.01)

(52) U.S. Cl.
USPC ..... 160/267.1; 160/274; 160/273.1

(58) Field of Classification Search
USPC ..... 160/267.1, 273.1, 280, 288, 23.1, 160/290.1, 272, 274, 275; 292/35
See application file for complete search history.

(56) References Cited

U.S. PATENT DOCUMENTS

| | | | | |
|---|---|---|---|---|
| 4,658,879 | A | 4/1987 | Van Klompenburg | |
| 4,825,921 | A * | 5/1989 | Rigter | 160/23.1 |
| 5,090,468 | A * | 2/1992 | Tedeschi | 160/290.1 |
| 6,082,432 | A * | 7/2000 | Kissinger | 160/290.1 |
| 6,405,781 | B2 * | 6/2002 | Davies et al. | 160/23.1 |
| 6,408,922 | B2 * | 6/2002 | Desrochers | 160/24 |
| 6,463,983 | B1 * | 10/2002 | Lang | 160/23.1 |
| 6,629,555 | B2 * | 10/2003 | DeBlock et al. | 160/31 |
| 6,701,994 | B2 * | 3/2004 | Goldenberg et al. | 160/31 |
| 6,758,503 | B2 * | 7/2004 | Sadler | 292/35 |
| 6,959,748 | B2 * | 11/2005 | Hudoba | 160/31 |
| 7,370,685 | B2 * | 5/2008 | Moriya et al. | 160/290.1 |
| 7,861,761 | B2 * | 1/2011 | Martineau et al. | 160/31 |
| 2005/0230065 | A1 * | 10/2005 | Moriya et al. | 160/271 |
| 2007/0029049 | A1 * | 2/2007 | Martineau | 160/23.1 |
| 2011/0114272 | A1 * | 5/2011 | Roberts | 160/293.1 |

FOREIGN PATENT DOCUMENTS

| | | |
|---|---|---|
| AU | 200154068 | 6/2001 |
| JP | 2002004753 | 1/2002 |
| TW | 440652 B | 3/2000 |
| WO | 9413923 | 6/1994 |

OTHER PUBLICATIONS

Examination Report in corresponding New Zealand Patent Application 589351, mailed Jan. 19, 2012.
Australian Application Serial No. AU2009905623, entitled "A Retractable Screen," filed Nov. 18, 2009, by Anthony Gerard Roberts.
Australian Application Serial No. AU2009238351, entitled "An Insect Screen," filed Nov. 20, 2009, by Anthony Gerard Roberts.

* cited by examiner

*Primary Examiner* — Blair M. Johnson
(74) *Attorney, Agent, or Firm* — William W. Cochran; Cochran Freund & Young LLC

(57) ABSTRACT

A retractable screen for extending across an architectural opening is disclosed. The retractable screen includes a fixed side having a fixed screen post; a displaceable handle post having an upper region and a lower region, the displaceable handle post is displaceable away from the fixed side towards a closed position, and is displaceable towards the fixed side back into an open position; at least one of an upper guide track and a lower guide track which is operatively engaged with the upper or lower region of the handle post and guides movement of the handle post between the open and closed positions. The retractable screen further includes a flexible sheet mesh extending between the fixed side and the displaceable handle post; and a brake arrangement for braking the movable handle post in a desired position intermediate the open and the closed positions, wherein the brake arrangement includes at least one brake assembly that is displaced into engagement with said at least one of the upper and lower guide tracks whereby to apply a braking action to the handle post.

19 Claims, 11 Drawing Sheets

RETRACTABLE SCREEN

CROSS-REFERENCE TO RELATED APPLICATION

The present application claims the benefit of and priority to Australian application serial number 2009905623, filed Nov. 18, 2009, by Freedom Screens of Australia Pty Ltd, the entire content of which is specifically incorporated herein by reference for all that it discloses and teaches.

BACKGROUND

A retractable screen comprises a flexible sheet mesh that can be drawn off a roller and across an architectural opening such as a door opening or a window opening. The screen is extendible between an open position in which the sheet mesh is substantially received within the housing and an extended or closed position in which the sheet mesh extends fully across the opening.

Retractable screens have found appeal amongst users because the screen rolls up on a compact roller when it is pulled back thereby opening up the full width of the architectural opening. This preserves an open and uninterrupted view through the architectural opening. This enhances the aesthetics of the architectural opening. It also encourages breezes and the like to pass through the architectural opening.

The sheet mesh provides a barrier to flying insects when it is in the extended or closed position. When it is retracted to the open position the sheet mesh rolls up on a roller and does not extend across an architectural opening.

SUMMARY OF THE INVENTION

Embodiments of this invention may therefore comprise a retractable screen, comprising: a fixed side having a fixed screen post; a displaceable handle post having an upper region and a lower region, that is displaceable away from the fixed side into an open position, and is displaceable towards the fixed side back into an open position; at least one of an upper guide track and a lower guide track which is operatively engaged with the upper or lower region of the handle post and guides movement of the handle post between the open and closed positions; a flexible sheet mesh extending between the fixed side and the displaceable handle post; and a brake arrangement for braking the movable handle post in a desired position intermediate the open and the closed positions, wherein the brake arrangement includes at least one brake assembly that is displaced into engagement with said at least one of the upper and lower guide tracks whereby to apply a braking action to the handle post.

Other embodiments may comprise a retractable screen comprising: a fixed screen post; a displaceable handle post that is displaceable towards and away from the fixed screen post between an open and a closed position; a flexible sheet mesh extending between the fixed post and the displaceable handle post, the sheet mesh having a stiffened upper edge region and a stiffened lower edge region; an upper guide track which is operatively engaged with an upper region of the handle post and guides movement of the handle post between the open and closed positions, wherein the upper guide track includes an elongate channel within which the stiffened upper edge region of the sheet mesh is received; a lower guide track which is operatively engaged with a lower region of the handle post and guides movement of the handle post between the open and closed positions, wherein the lower guide track includes an elongate channel within which the stiffened lower edge region of the sheet mesh is received; and a roller onto which the sheet mesh is rolled when the handle post moves from the closed to the open position and from which the sheet mesh is drawn when the handle post moves from the open to the closed position.

BRIEF DESCRIPTION OF THE DRAWINGS

In the accompanying diagrammatic drawings:

In FIGS. 1 to 8 reference numeral 10 refers generally to a retractable screen in accordance with one embodiment of the invention.

DETAILED DESCRIPTION OF THE EMBODIMENTS

Figure 1:
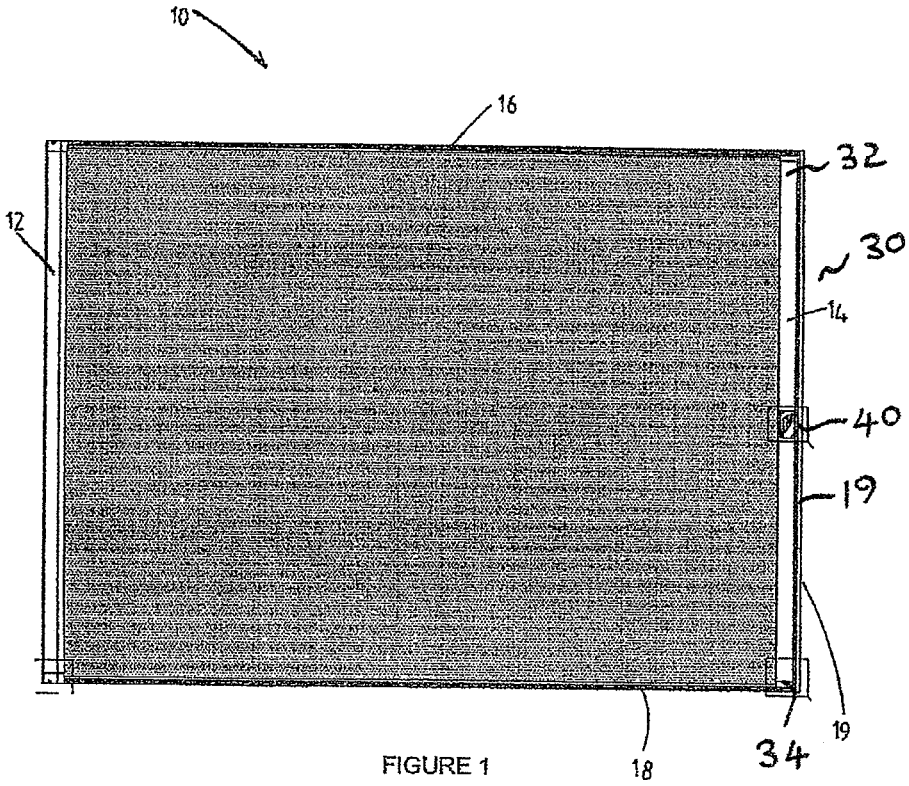
FIG. 1 is a front view of a retractable screen in accordance with one embodiment of the invention.
Figure 2:
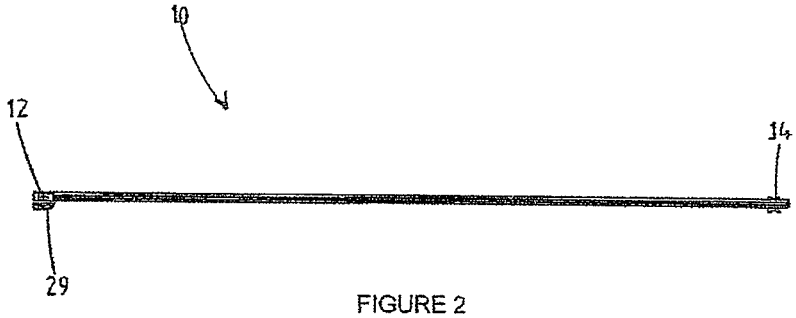
FIG. 2 is a plan view of the retractable screen of FIG. 1.

A retractable screen for extending across an architectural opening to provide the ability to screen off the opening against the passage of flying insects in accordance with the invention may manifest itself in a variety of forms. It will be convenient to hereinafter describe in detail one embodiment of the invention with reference to accompanying drawings. The purpose of providing this detailed description is to instruct persons having an interest in the subject matter of the invention how to carry the invention into practical effect. However it is to be clearly understood that the specific nature of this detailed description does not supersede the generality of the preceding broad description.

The screen includes a fixed support post on which the roller is mounted and a displaceable handle post that is moved towards and away from the fixed post when the screen is moved between the open and closed positions. The screen also includes a receiver post that is mounted on the opposite side of the opening to the fixed post. The handle is positioned adjacent to the receiver post when the screen is in the closed position and the handle can be latched to the receiver post in the closed position.

The sheet mesh is stored in a roll form on the roller which is received within a compact cylindrical housing. The roller includes a recoil spring that biases the roller to a rolled up position. Thus in the absence of the sheet mesh being held in a position in which it is fully or partly drawn off the roller the sheet mesh will tend to move to the open position in which it is rolled up on the roller and received within the housing under the influence of the recoil spring. A retractable screen is sometimes known as a disappearing screen because the action of the recoil spring causes it to disappear into the housing when it is released.

The displaceable handle post runs along upper and lower guide tracks that extend between the fixed post and the receiver post. The handle post draws the sheet mesh off the roller and draws it tautly across the space defined between the handle post and the fixed post, e.g. the housing within which the roll of sheet mesh is received. The sheet mesh typically extends up the full height of the handle post and thereby covers the full height defined between the upper and the lower guide tracks. The recoil spring on the roller applies a tensioning force to the sheet mesh which helps to draw it taut across the surface area defined between the roller and the handle post.

With retractable screens, the handle post can be latched to the receiver post when the screen is in the closed position. However with some retractable screens once the handle post is unlatched and released from the receiver post, the recoil spring winds the sheet mesh onto the roller. This pulls the handle post with it and as a result causes the screen to move to the open position. These screens have no intermediate position, between the open and closed positions, in which the screen can be stopped and be held in this position without user intervention.

The door is either in a fully open or a fully closed position and the only way that the door can be fixed in an intermediate position, is when it is manually held by a user in the intermediate position with a force that is sufficiently strong to resist the biasing force of the recoil spring. However if and when the user releases the door then it will move immediately to the open position under influence of the recoil spring. Further the handle post will tend to move with greater speed as it approaches the fixed post due to the strength of the recoil spring.

It would be beneficial if a user could brake or fix the handle post in an intermediate position in some situations. For example a user might like to open the screen door a small distance for a short time, e.g. to permit people to pass through the opening, without moving the screen to a fully open position.

The prior art retractable screens clearly have their drawbacks as discussed above. Accordingly it would clearly be useful if a contrivance could be devised for enabling a retractable screen to be checked in an intermediate position between open and closed positions. It would be further advantageous if such a contrivance was able to brake the screen in a desired position efficaciously and with minimal effort on the part of a user.

The retractable screen 10 comprises broadly a fixed screen post 12, and a displaceable handle post 14 that is displaceable towards and away from the fixed screen post 12 between an open position and a closed position (shown in FIG. 1).

The screen 10 includes an upper guide track 16 which is operatively engaged with an upper end of the handle post 14 and guides movement of the handle post 14 between the open and closed positions. The screen 10 also guides a lower guide track 18 which is operatively engaged with a lower end of the handle post 14 and similarly guides the handle post 14. The screen 10 also includes a receiving post 19 on the opposite side of the screen 10 to the fixed post 12 and against which the handle post 14 abuts in the closed position.

The screen 10 also includes a flexible sheet mesh 24 extending between the fixed post 12 and the displaceable handle post 14. The screen 10 also includes a roller 26 onto which the sheet mesh 24 is rolled when the handle post 14 moves from the closed to the open position and from which the sheet mesh 24 is drawn when the handle post 14 moves from the open to the closed position. The roller 26 is biased towards a rolled up condition in which the sheet mesh 24 is rolled up onto the roller 26 by a recoil spring (not shown). The roller 26 is received within a compact housing 29 which is mounted on or adjacent the fixed post 12.

Further the screen 10 also includes a brake arrangement that is indicated generally by reference numeral 30 for braking the movable handle post 14 in a desired position intermediate the open and the closed positions.

The brake arrangement 30 includes two brake assemblies, namely an upper brake assembly 32 that is arranged to engage the upper track 16, and a lower brake assembly 34 that is arranged to engage the lower track 18. Each of the upper and lower brake assemblies 32, 34 is mounted so that they are displaceable in a vertical direction into and out of engagement with the upper and lower tracks 16, 18. The brake arrangement 30 also includes a brake control 40 for enabling a user to control actuation of the two brake engagement assemblies 32, 34.

Only one of the brake assemblies 32, 34 is shown in FIGS. 1 to 12 namely brake assembly 34. Given that the brake assemblies 32, 34 are substantially identical only the lower brake assembly 34 is shown and described.

Each of the components will now be described in more detail below.

Figure 3:
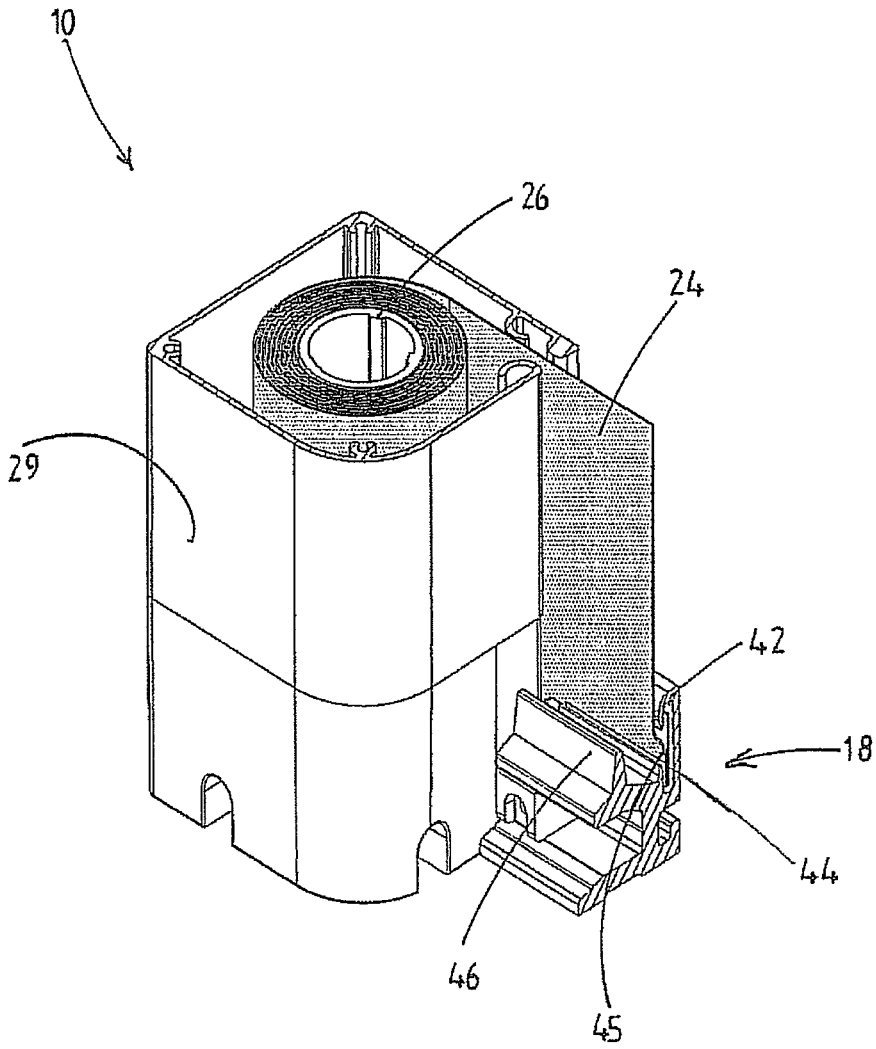
FIG. 3 is a three dimensional cut away of part of a fixed post and a housing and a lower guide track of the retractable screen of FIG. 1.
Figure 4:
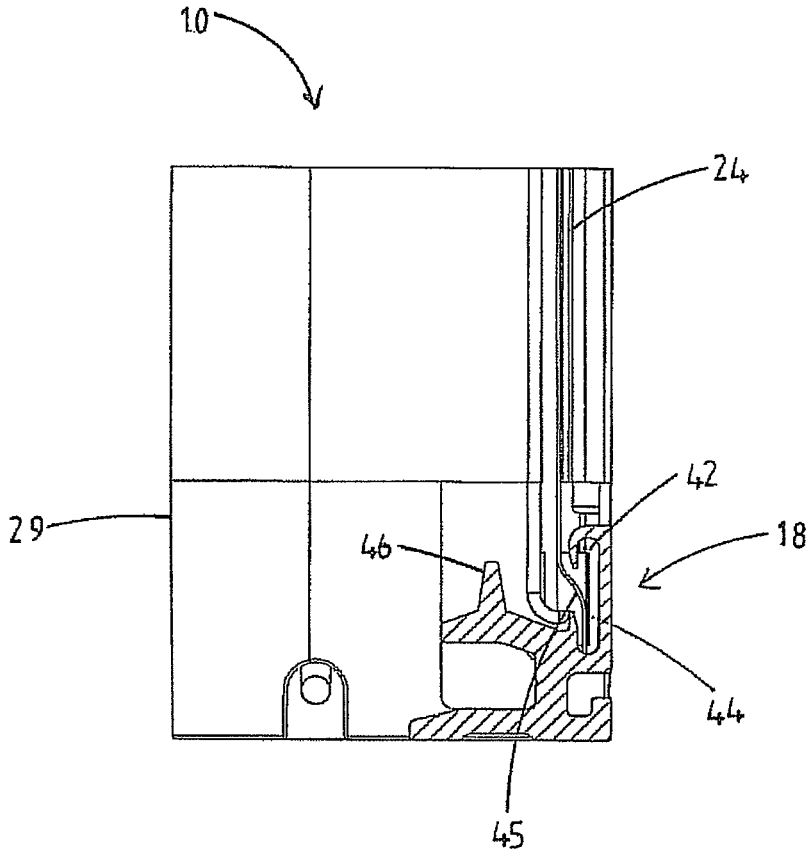
FIG. 4 is a side view of the cut away of the fixed post and the housing of the screen of FIG. 1.
Figure 5:
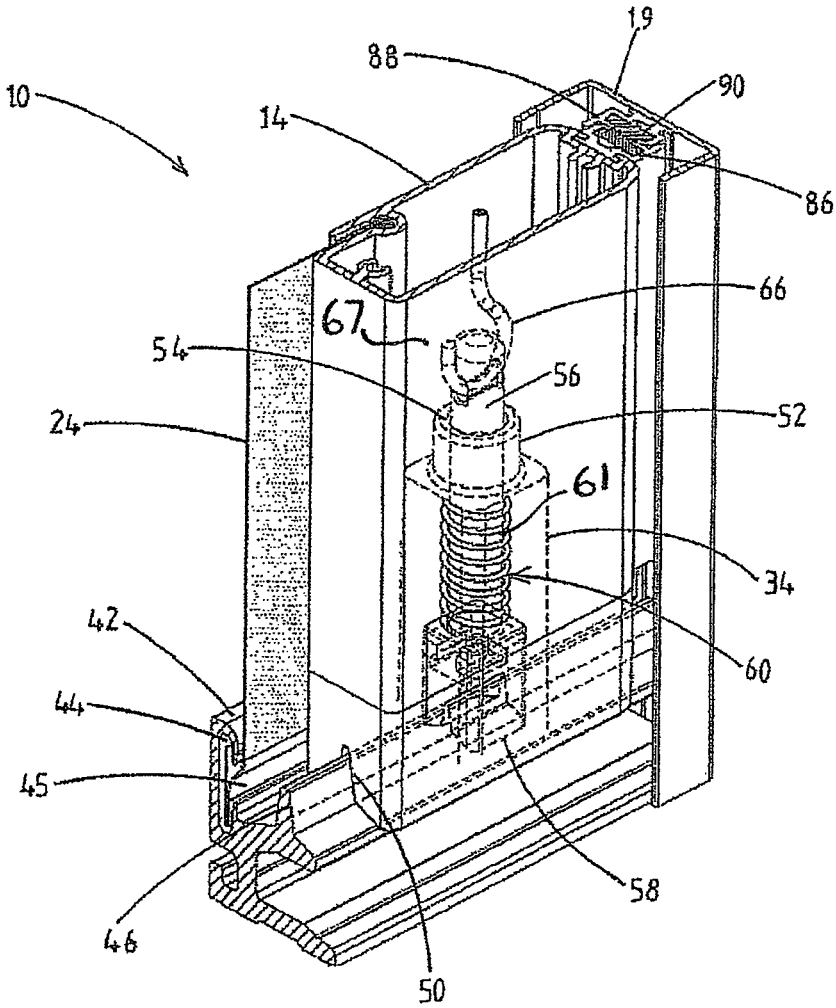
FIG. 5 is a three dimensional view of another part of the retractable screen showing the displaceable handle post and the lower guide track and also a receiver post.
Figure 6:
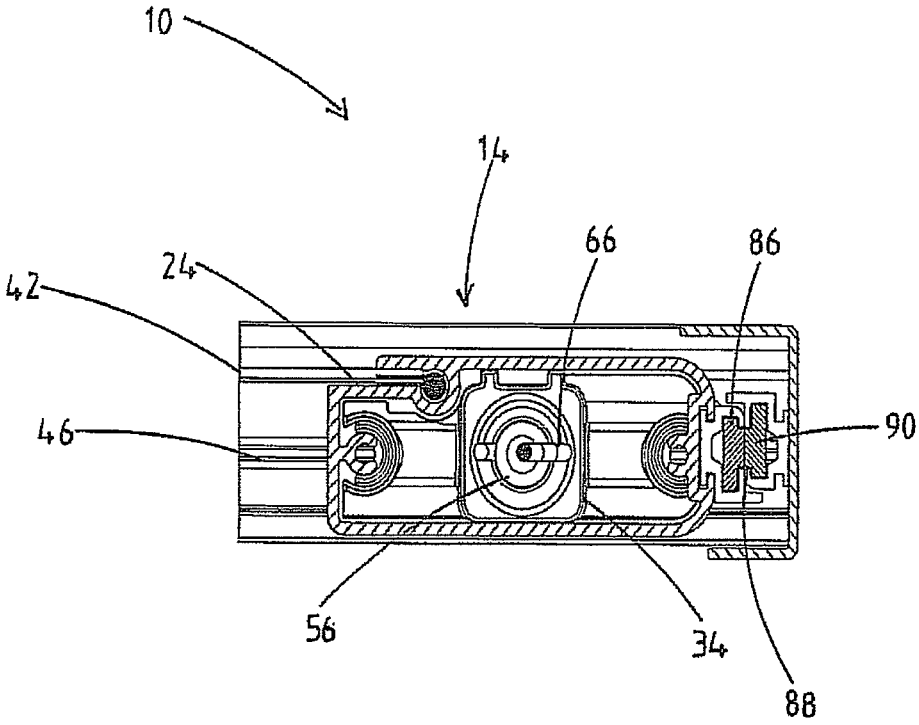
FIG. 6 is a top plan view of the part of the screen that is shown in FIG. 5.
Figure 7:
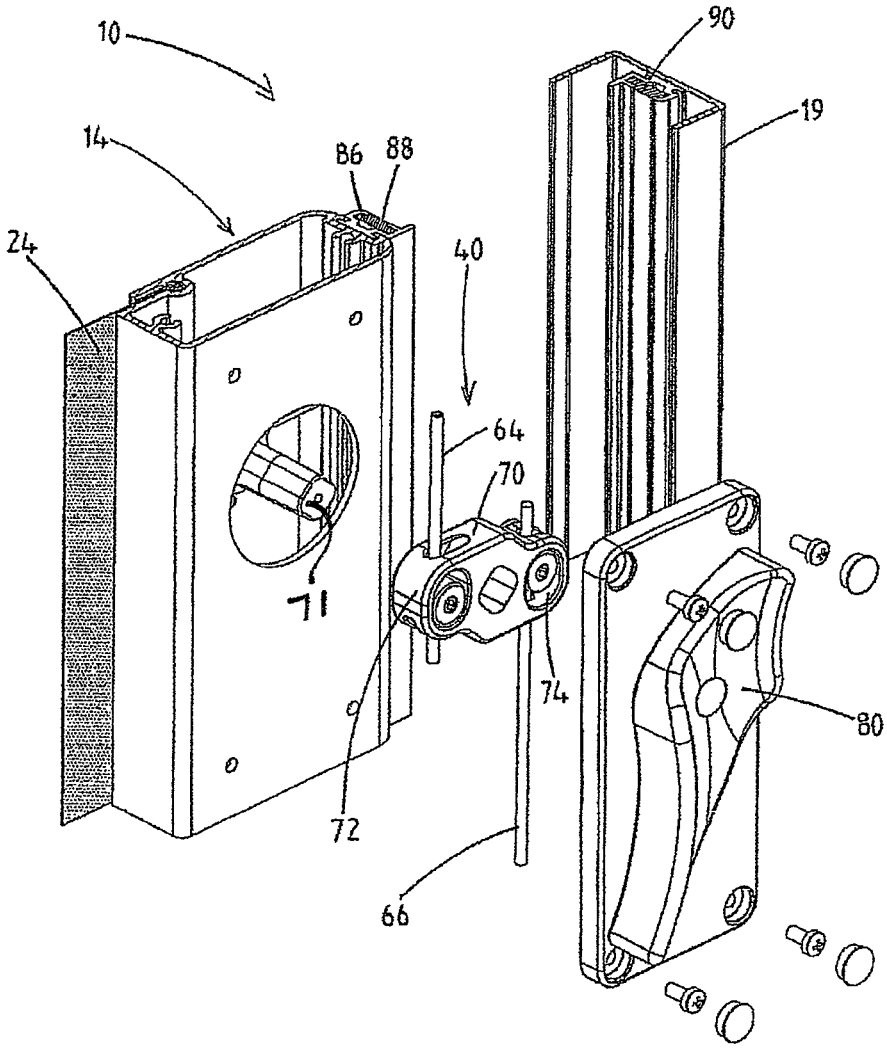
FIG. 7 is a three dimensional view of another part of the screen of FIG. 1 showing the handle post and the rotatable handle for disengaging the brake.
Figure 8:
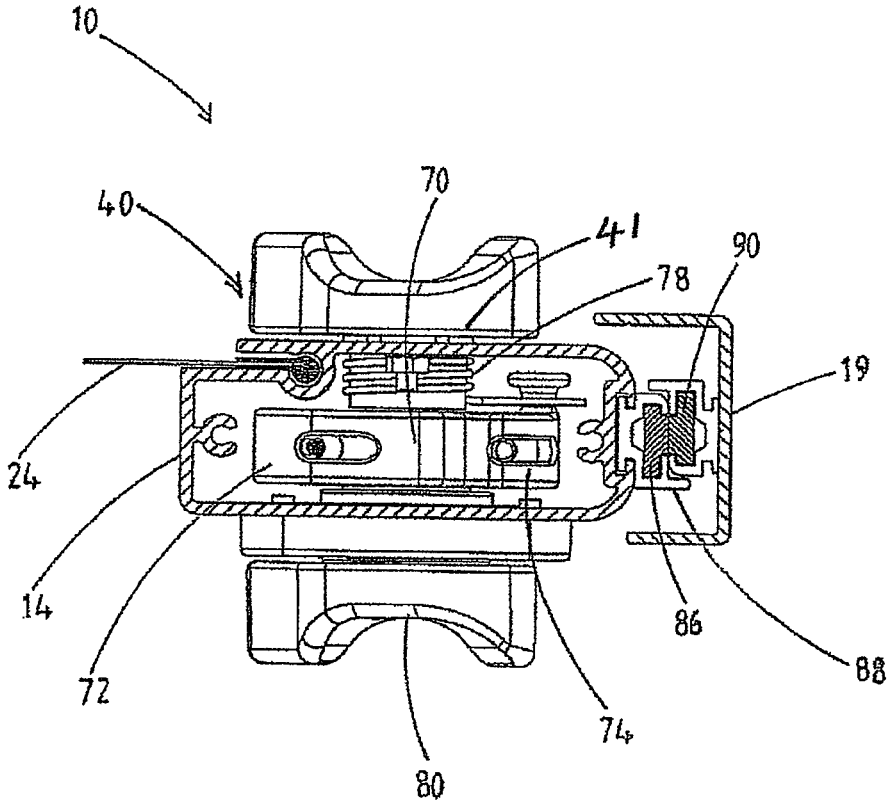
FIG. 8 is a top plan view of the part of the screen that is shown in FIG. 7.

The upper and lower guide tracks 16, 18 include a mesh receiving channel 42 for receiving an edge region 44 of the sheet mesh 24 therein. The mesh receiving channel 42 on the lower guide track 18 is shown in FIGS. 3 and 4.

The upper guide track 16 has a similar cross sectional profile to the lower guide track 18 while having some differences that are occasioned by the fact that it is the upper guide channel. In some respects the upper guide track 16 is a lateral inversion of the lower guide track 18.

The upper and lower guide tracks 16, 18 also include guide rail formations 46 for guiding the upper and lower ends of the handle post 14 in a line from the fixed post 12 to the receiving post 19.

The sheet mesh 24 has a stiffened upper edge region or rib 44 extending the length thereof that is sized to be received within the mesh receiving channel 42 of the upper guide track 16. The stiffened region 44 is sized to be received within the channel 42 in a flat orientation with some clearance so as to permit the rib 44 to slide in a longitudinal direction through the channel 42 as the handle post 14 is moved between open and closed positions.

The sheet mesh 24 extends away from the rib 44 thereof at a point 45 intermediate the upper and lower edges of the rib 44 (as shown in FIGS. 3 and 4). The sheet mesh 24 bends laterally in a direction away from the rib 44 and is passed through a longitudinal slot or opening in the mesh receiving channel 42 and from there it extends across the face of the screen 10.

The sheet mesh 24 has a similar lower edge region or rib 44 that is sized to be received within the mesh receiving channel 42 of the lower guide track 18. This feature is shown in FIGS. 3 and 4 of the drawings.

The upper and lower guide tracks 16 and 18 also each include a passive brake engaging formation 46 for engaging the upper and lower brake assemblies 32, 34 respectively. The passive brake engaging formation 46 is laterally spaced away from the mesh receiving channel 42 of the associated track 16 or 18, being positioned forward thereof. The passive brake engaging formation 46 on the lower guide track 18 is shown in FIGS. 3 and 4. In the illustrated embodiment the passive brake engaging formation 46 has a wedge shaped profile with the wedge being oriented in a vertically extending orientation with the thin end of the wedge facing upwardly.

In the illustrated embodiment the upper and lower guide rail formations guiding the handle post 14 are the same as the passive brake engaging formations 46 and the formations 46 serve both purposes.

Each brake assembly 32, 34 includes a brake support 50 which is mounted on the handle post 14 and a brake engaging member 52 that is mounted on the support 50 and can be displaced relative to the support 50. The support 50 is in the form of a block that is mounted on the handle post 14 e.g. in a fixed position, and defines a passage 54 therethrough. The brake engaging member 52 in turn comprises a shank 56 and an operative engagement formation 58 towards an end of the shank 56 that is adjacent to the passive brake engaging formation 46.

The shank 56 is mounted in the passage 54 of the support 50 and is capable of sliding displacement within the passage 54 whereby to displace the operative engagement formation 58 at the end of the shank 56 into and out of engagement with the passive braking formation 46. The movement of the brake engaging member 52 is guided by the support 50 which guides the movement of the shank 56 in the passage 54.

Each brake assembly 32, 24 also includes a brake assembly biasing arrangement 60 mounted on the associated support 50 for resiliently biasing the brake engaging member 52 into engagement with the associated track. It also permits the brake assembly 32, 34 to conform to and adjust to the passive braking formation 46 on the guide track 16, 18 by conferring on it the ability to yield resiliently. The brake assembly biasing arrangement 60 comprises a helical coil spring 61 extending between the operative engagement formation 58 and the brake engaging member 52 under compression.

The operative engagement formation 58 of each brake engagement assembly 32, 34 is of complementary shape to the passive brake engaging formation 46, whereby to enable it to engage the wedge-shaped passive braking formation 46 with a braking grip.

The brake arrangement 30 further includes brake rods 64, 66 that operatively connect the brake control 40 to the brake assemblies 32, 34. One brake rod 64 is an upward extending brake rod extending from the brake control 40 to the upper brake assembly 32. Another brake rod 66 extends downward form the brake control 40 to the lower brake assembly 34. Each brake rod 64, 66 is directly coupled to its associated brake assembly 32, 34 such that displacement of the brake rods 64, 66 in a vertical direction translates into a corresponding displacement of the associated brake assembly 32, 34. In the illustrated embodiment each brake rod 64, 66 has a hook formation 67 at its end for passing on the shank 56 of the brake engaging member 52.

The brake control 40 includes a pivot member 70 that is pivotally mounted to the handle post having one portion 72 on one side of the pivotal mounting 71 and another portion 74 on the other side of the pivotal mounting 71.

The first brake rod 64 extends from one side portion on the pivot member 70 to the upper brake assembly 32 and the second brake rod 66 extends from the other side portion of the pivot member 70 to the lower brake assembly 34. The brake rods 64, 66 are directly coupled to the pivot member 70 and to the brake engagement members 52 so that movement of the pivot member 70 is translated directly to the brake engagement members 52.

The brake control 40 includes a control biasing arrangement 41 for biasing the upper brake rod 64 and the upper brake assembly 32 that is operatively coupled thereto into a braking position in which the operative engagement formation 58 is engaged with the passive brake formation 46 of the upper track 16. The control biasing arrangement 41 also biases the lower brake rod 66 and the lower brake assembly 34 that is operatively coupled thereto into a braking position in which the operative engagement formation 58 is engaged with the lower track 18.

Conveniently the control biasing arrangement 41 is in the form of a torsion spring 78 acting between the pivot member 70 and the handle post 14 and biasing the pivot member 70 in a certain direction to urge the brake assemblies 32, 34 64, 66 towards positions in which the brake assemblies 32, 34 are engaged with their respective guide tracks 16, 18.

The brake control 40 also includes a control handle 80 that is operatively connected to the pivot member 70 so that rotation of the handle 80 by a user causes the pivot member 70 to pivot. This way the handle 80 can be used overcome the bias of the torsion spring 78 and pivot the pivot member 70 in an opposite direction to the torsion spring to withdraw the brake assemblies 32, 34 out of braking engagement with the guide tracks 16, 18. In the illustrated embodiment the control handle 80 is directly coupled to the pivot member 70 so that rotation of the control handle 80 is directly transmitted to the pivot member 70 to cause it to pivot, and a certain rotation of the control handle 80 produces a corresponding pivoting movement of the pivot member 70.

The handle post 14 includes a handle post magnet 86 for sticking to another magnet when the screen 10 is in a closed condition. The magnet 86 comprises a magnet strip that is received within a magnet channel 88 on the handle post 14 that runs vertically from a lower end of the handle post 14 to an upper end thereof. The magnet channel is on an outer surface of the handle post 14 that abuts the receiving post 19 when the screen is closed. The magnet recess is positioned on the outside of the post 14 as distinct from being received within the post 14.

The receiving post 19 has a complementary receiving post magnet 90 for sticking to said one magnet 86 on the handle post 14. The receiving post magnet 90 comprises a magnet strip that extends in a vertically extending orientation from a lower end of the receiving post 19 to an upper end thereof. Further the receiving post magnet 90 is open to the handle post 14 so that it can come into magnetic contact with the handle post magnet 86. The handle post and receiving post magnets 86, 90 releasably stick to each other when the handle post 14 is moved to the closed position and helps to fully close the screen 10.

The illustrated screen 10 also includes a locking arrangement for locking the handle post 14 to the receiving post 19. In a rudimentary form this comprises an active latching formation on the handle post 14 that can be moved by a user between locked and unlocked positions for engaging a passive latching formation on the receiving post 19. While the locking arrangement has not been illustrated in the drawings it would be well known to persons skilled in the art and therefore will not be described in further detail in this specification.

In a further embodiment of the present invention and as shown in FIGS. 9 to 12, the fixed post 12 includes a roller assembly 120 onto which the sheet mesh 24 is rolled when the handle post 14 moves from the closed to the open position and from which the sheet mesh 24 is drawn when the handle post 14 moves from the open to the closed position. The fixed post 12 includes one roller assembly 120 located in the lower end of the fixed post 12 within the compact housing 29. Alternatively the fixed post 12 may include two roller assemblies 120, one located in the lower end of the fixed post 12 and the other located in the upper end of the fixed post 12. This is particularly useful when a retractable screen is used in a large opening.

Figure 9:
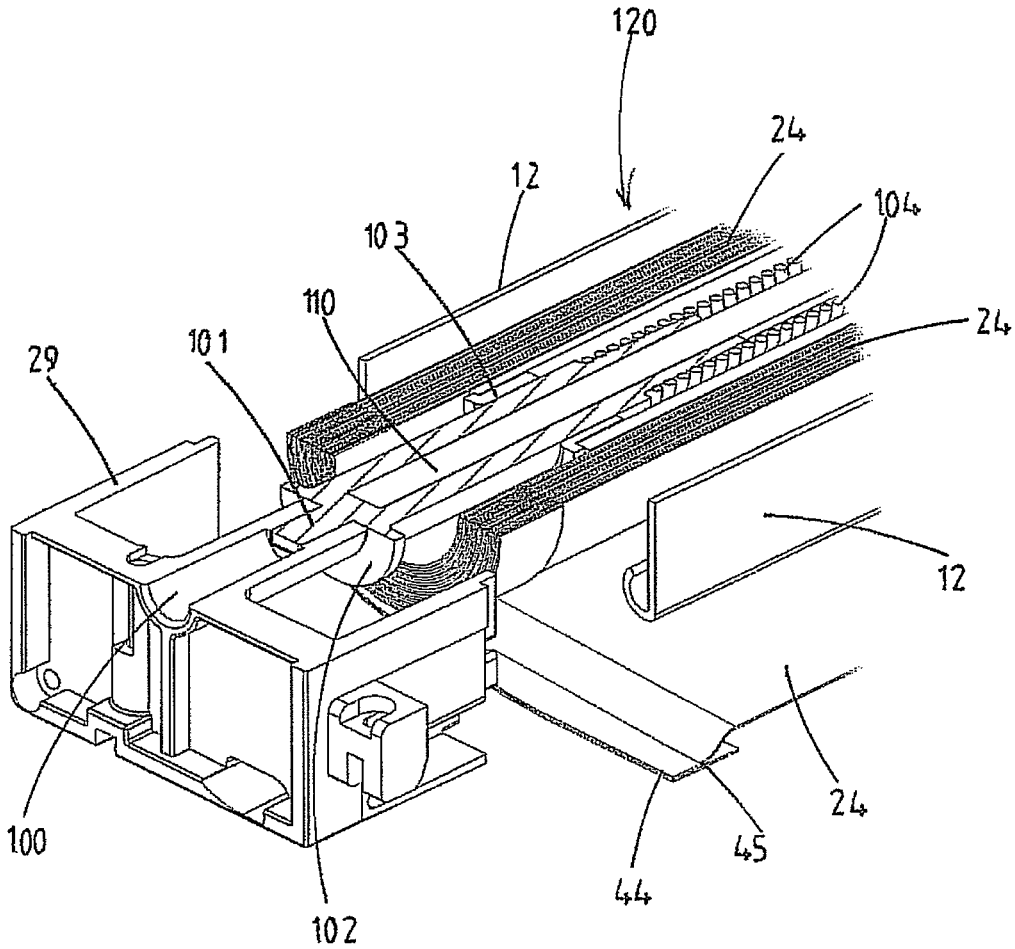
FIG. 9 is a three dimensional cut away view of the fixed post in accordance with a further embodiment of the present invention.
Figure 10:
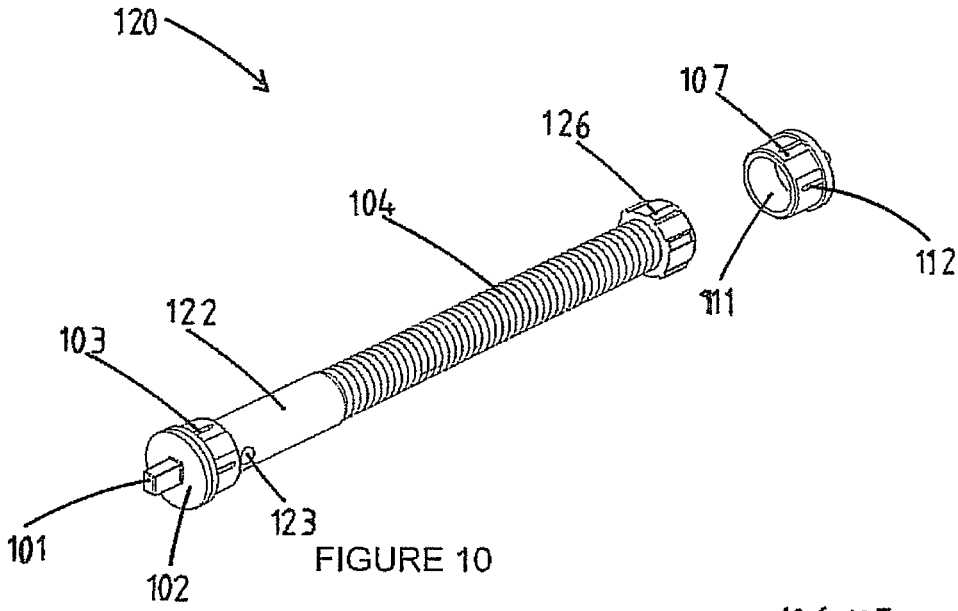
FIGS. 10 and 10*a* show a three dimensional view of the assembled and dissembled spring assembly used in the fixed post of FIG. 9.
Figure 10A:
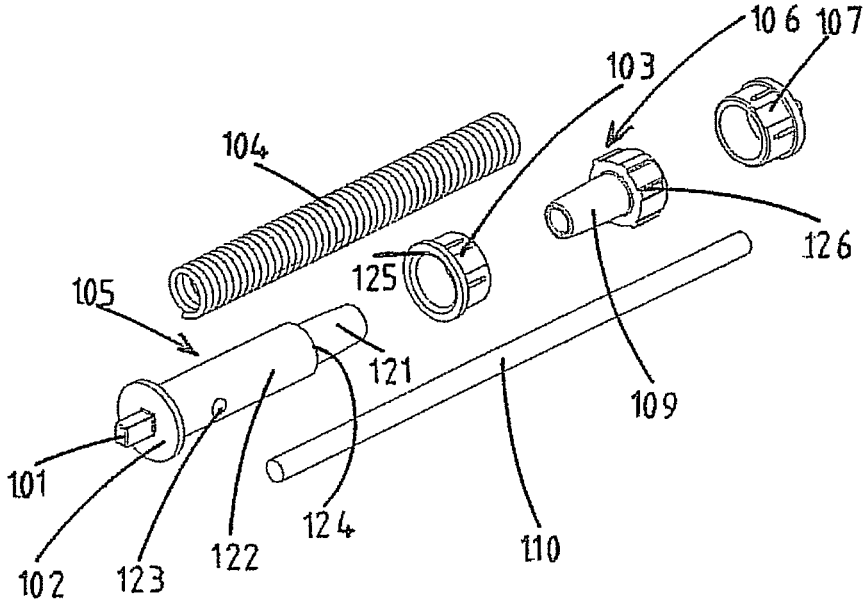

FIG. 9 shows the roller assembly 120 with its lower end and projection 101 located within recess 100 of the compact housing 29. A flange 102 located at the base of the projection 101 abuts against a surface of the compact housing 29 to assist in locating the projection 101 within the recess 100. The flexible sheet mesh 24 is rolled around the roller assembly 120 and the roller assembly 120 is biased towards a rolled up condition in which the sheet mesh 24 is rolled up onto the roller assembly 120 by a recoil spring 104. The roller assembly 120 is constructed as a single component which may be easily removed for maintenance or replacement.

At one end of the cylindrical body 122 the cap 103 fits up against a bottom side of the flange 102. The cap 103 has a collar 125 projecting around a bottom edge of the cap 103 which fits into the roller 26 and secures the spring assembly 120 at its lower or bottom end. Dependent upon the amount of tension applied to the spring 104 varies the position of the cap 103. For example, the end cap may be positioned away from the bottom flange 102 as shown in FIG. 9.

The roller assembly 120 includes a hollow tubular body 105 extending longitudinally along an axis from one end which includes the projection 101 and the flange 102 and at the other end includes a sleeve 121 over which the spring 104 is mounted. The spring 104 abuts against the wall 124 formed at the junction of the sleeve 121 and the cylindrical body 122. A cap 103 is slidingly fitted over the cylindrical body 122 and is positioned into a bottom end of the roller 26.

A strengthening rod 110 is fitted inside the spring 104 and within the hollow tubular body 105 to reinforce the roller assembly 120. To hold the rod 110 and spring 104 in place a fitting 106 is placed over the end of the spring 104. The fitting 106 includes a sleeve 109 that fits within the spring 104 to secure the rod 110 in place and a raised outer section 126 which keeps the spring 104 tensioned or biased up against the tubular body 105 to enable the flexible sheet mesh 24 to be rolled around the roller assembly 120.

A recess 123 within the tubular body 105 is used to locate a complementary recess on the rod 110 and aid in securing the rod 110 within the roller assembly 120. Any suitable fixing device may be used to secure the rod within the tubular body 105, for example a locking pin or the like. An end cap 107 has both an internal surface 111 for engaging the external surface of the raised outer section 126 and an external surface 112 which is fitted into one end of the roller 26. The roller 26 is attached to the roller assembly 120 by end cap 107 at the top end of the roller 26 and cap 103 which is fitted into the bottom end of the roller 26.

Figure 11:
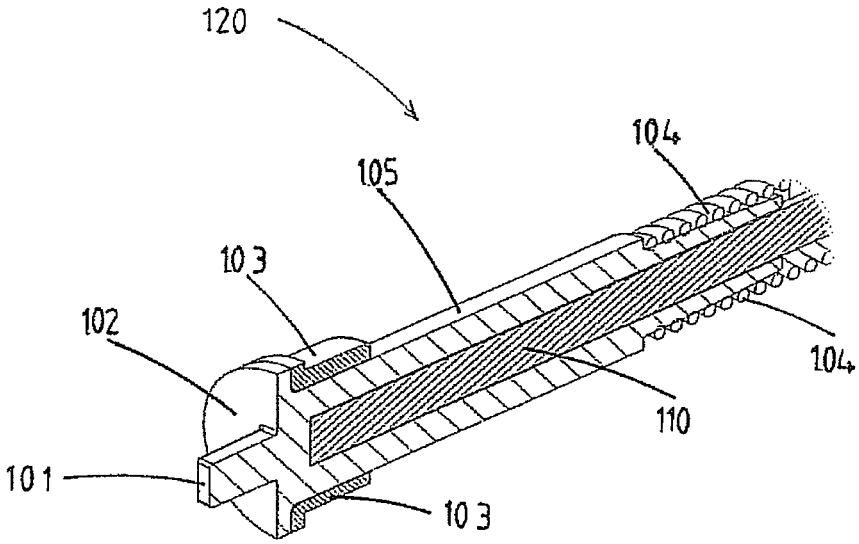
FIGS. 11 and 11*a* show a three dimensional cut away view of the spring assembly used in the fixed post of FIG. 9.
Figure 11A:
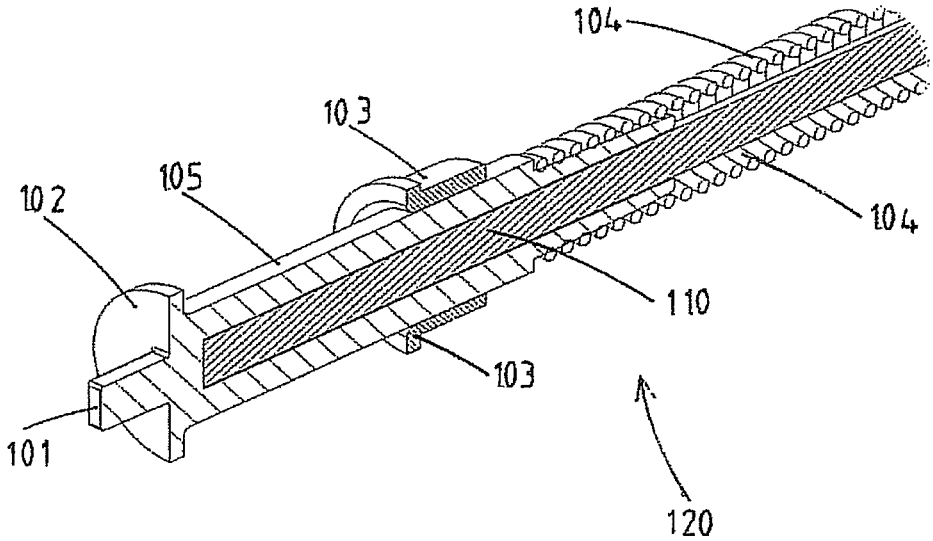

FIGS. 11 and 11*a* show a three dimensional cut away view of the spring assembly 120. The rod 110 is inserted inside the spring 104 and the tubular body 105 to reinforce the spring assembly 120. The rod 110 may be manufactured from steel or any other material which would support the spring assembly 120. The spring 104 may be constructed from hardened steel or any other material which has the required combination of rigidity and elasticity.

The spring 104 is a torsion spring which unlike other types of springs in which the load is an axial force, the load applied to a torsion spring is a torque or twisting force, and the end of the spring 104 rotates through an angle as the load is applied. A torsion spring 104 is a flexible elastic object that stores mechanical energy when it is twisted. The amount of force or torque it exerts is proportional to the amount it is twisted.

Figure 12:
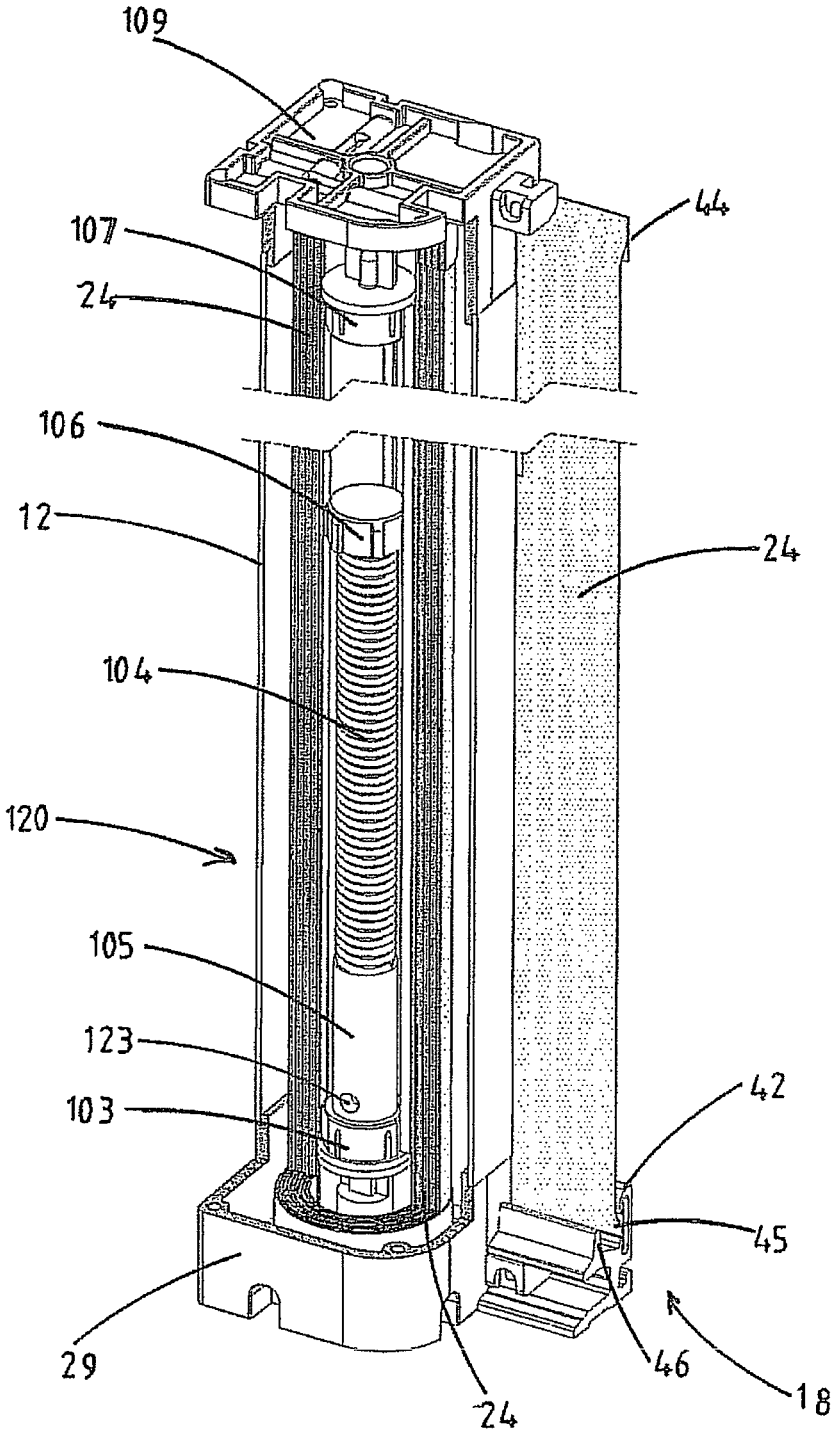
FIG. 12 shows a three dimensional cut away and partial section view of the fixed post of FIG. 9.

FIG. 12 shows a three dimensional cut away and partial section view of the fixed post 12. As described above a single roller assembly 120 may be used in the fixed post 12, alternatively more than one roller assembly 120 may be used. In FIG. 12 only one roller assembly is used which is fitted within the fixed post 12 and located within the compact housing 29 at a lower end of the fixed post 12 and in top housing 109 at the top end of the fixed post 12. As shown the end cap 107 is fitted into the top housing 109 of the fixed post 12.

In use, the screen 10 can be mounted across a door opening whereby to provide a sheet mesh 24 extending across the door opening to stop flying insects from flying in through the door opening. The fixed post 12 is mounted on one side of the door opening and the receiving post 19 is mounted on the other side of the door opening. The housing 29, enclosing the roller 26, is mounted on or adjacent to the fixed post 12.

In a resting or inoperative position the screen 10 is in the open position with the handle post 14 being positioned adjacent to the fixed post 12 and the mesh screen 24 being largely rolled up on the roller 26 and received within the housing 29.

The retractable screen 10 might be moved to a closed position when a solid door or doors extending across the door opening is in an open condition and it is desired to screen the opening to resist entry by flying insects.

To do this a user slides the handle post 14 in a direction away from the fixed post 12 towards the receiving post 19. As the handle post 14 is displaced away from the fixed post 12 and the housing 29, the sheet mesh 24 is unwound off the roller 26 and drawn across the area defined between the handle post 14 and the fixed post 12 and also between the upper guide track 16 and the lower guide track 18. The handle post 14 is guided in its sliding displacement away from the fixed post 12 towards the receiving post 19 by the upper and lower guide tracks 16, 18. More specifically the upper end of the handle post 14 engages the guide rail track which is also the upper passive braking formation 46 and guides it precisely across the opening towards the receiving post 19. The lower end of the handle post 14 similarly engages the lower guide rail that is also the passive braking formation 46 and guides it precisely across the opening towards the receiving post 19.

The ribs 44 on the upper and lower edge regions of the sheet mesh 24 run along the upper and lower guide channels 16, 18 within the mesh receiving channels 42 thereof. This helps to physically attach or anchor the upper and lower edge regions to the guide channels 16, 18, as the sheet mesh 24 is drawn along the channels 42. This gives the sheet mesh a neat and taut appearance extending across the face of the screen 10. It also resists the upper and lower edges of the sheet mesh being blown out of the mesh receiving channels 42 along its upper or lower edges.

When moving the handle post 14 relative to the fixed post 12 the user will need to release the brake engagement members 52 from their braking engagement with the upper and lower passive braking formations 46. As described above the brake is biased to an engaged condition by the brake arrangement 60 and this needs to be released to move the handle post 14. The brake arrangement 50 is released by a user by their manual rotation of the handle 80 of the brake control on the handle post 14 of its resting position. This displaces the brake assemblies 32, 34 out of engagement with the upper and lower guide tracks 16, 18. Once this has been done the handle post 14 can be moved easily and smoothly along the guide tracks 16, 18 either towards the receiving post 19 or away from the receiving post 19.

If a user releases the control handle 80 at any point the brake engagement assemblies 32, 34 will engage the upper and lower guide tracks 16, 18 under influence of the torsion spring 78 on the brake control 40 and this will cause the handle post 14 to stop in that chosen or desired position and to stay in that position until it is moved out of that position. Accordingly if a user desires to position the screen with the handle post 14 positioned intermediate the fixed and receiver posts 12, 19 they simply release the control handle 80 and the handle post 14 will automatically be braked in that position. In particular it will not automatically return to the fixed post 12 and wind the sheet mesh 24 onto the roller 26 as occurs with some prior art screens.

Thereafter if the user wants to move the screen 10 from its intermediate position to a fully closed position to abutting the receiver post 19 they turn the control handle 80 once more out of its resting position to release the brake assemblies 32, 34 and then slide the handle post 14 fully towards the receiving post 19. The handle post 14 can attach to the receiving post 19 and thereby close the screen 10.

An advantage of the retractable screen 10 described above with reference to the drawings is that it provides a brake arrangement that is very efficacious at braking and checking the handle post 14 in any desired position in between the open and closed positions. A user can select any position and the screen 10 can be braked in that position. A further advantage is that the brake is biased towards a position in which the brake is engaged and therefore no manual effort or action is required by a user to cause the handle post 14 to be braked. The brake elements apply a firm and effective gripping action on the upper and lower tracks 16, 18 and this holds the handle post 14 in the desired position against the recoil force applied by the recoil spring in the housing. Further the brake can be released by a simple manual rotation of a brake release handle on the handle post 14. The handle 80 is rotated through about 20 to 40 degrees with a modest manual force that overcomes the bias that biases the brake into engagement with the guide tracks 16, 18.

A further advantage of the retractable screen 10 described above with reference to the drawings is that stiffened upper and lower edge regions of the sheet mesh 24 in the form of ribs are received within elongate mesh channels within the upper and lower tracks. The ribs and the mesh receiving channels are designed so that the upper and lower edges of the sheet mesh 24 resist being pulled out of these channels, e.g. by wind force applied against sheet mesh, extending between the fixed 12 and handle posts 14.

A yet further advantage of the retractable screen described above and illustrated in the drawings is that the brake arrangement has a construction that is not unduly complex.

Hence, the disclosed embodiments are directed to a retractable screen that is an insect screen for extending across a door opening and it will therefore be convenient to hereinafter describe the invention with reference to this example application. However it is to be clearly understood that the invention is capable of broader application. For example the invention applies equally to retractable screens that are not insect screens. Yet further the invention also extends to screens that extend across other architectural openings such as window openings, sky lights, roof windows, and security screens.

It will of course be realised that the above has been given only by way of illustrative example of the invention and that all such modifications and variations thereto, as would be apparent to persons skilled in the art, are deemed to fall within the broad scope and ambit of the invention as is herein defined and described.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A retractable screen assembly comprising:

a fixed screen post;

a displaceable handle post having a first end region that is an upper end region and an opposed second end region that is a lower end region, said displaceable handle post being displaceable away from said fixed screen post towards a closed position, and being displaceable towards said fixed screen post back into an open position;

a first guide track that is an upper guide track and a second guide track that is a lower guide track, which are respectively operatively engaged with said first end region and said second end region of said displaceable handle post that guides movement of said displaceable handle post between said open and said closed positions;

a flexible sheet extending between said fixed screen post and said displaceable handle post;

a roller at said fixed screen post onto which said flexible sheet is rolled when said displaceable handle post moves from said closed position to said open position and from which said sheet is drawn when said displaceable handle post moves from said open position to said closed position, said roller having a recoil spring which biases said displaceable handle post to said open position; and a brake arrangement for braking said displaceable handle post in a selected position intermediate to said open position and said closed positions, comprising:

a first brake assembly that is displaceable in a vertical direction to engage and disengage said first guide track;

a second brake assembly that is displaceable in a vertical direction to engage and disengage said second guide track;

wherein said first guide track and said second guide track include guide rail formations on which said displaceable handle post is mounted, for guiding said displaceable handle post along said first guide track and said second guide track, said guide rail formations forming a passive brake engaging formation which is engaged by said brake engaging members to brake said displaceable handle post, said passive brake engaging formation having a constant wedge shaped cross-sectional profile that extends the length of said upper guide track and said lower guide track that engages an operative engagement formation of said brake engaging member, said operative engagement formation having a cross-sectional shape that is complementary to said constant wedge shaped cross-sectional profile of said passive brake engaging formation; and wherein said wedge shaped cross-sectional profile is arranged in a vertically extending orientation; and wherein said passive brake engaging formation is spaced away from a mesh receiving channel in a direction that is transverse to a longitudinal direction of said upper guide track and said lower guide track and said passive brake engaging formation is spaced laterally away from said mesh receiving channel, a first brake assembly biasing arrangement that generates a first biasing force that resiliently biases said first brake assembly for engagement with said first guide track;

a second brake assembly biasing arrangement that generates a second biasing force that resiliently biases said second brake assembly for engagement with said second guide track;

a single brake control which is mounted on said displaceable handle post and operatively connected to said first brake assembly biasing arrangement and said second brake assembly biasing arrangement, said single brake control being manually operated to overcome said first biasing force generated by said first brake assembly biasing arrangement and said second biasing force generated by said second brake assembly biasing arrangement to release said brake arrangement and permit said displaceable handle post to be moved along said first guide track and said second guide track.

2. The retractable screen assembly according to claim 1, wherein said retractable screen assembly further includes a roller onto which said flexible sheet is rolled when said displaceable handle post moves from said closed to said open position and from which said flexible sheet is drawn when said displaceable handle post moves from said open position to said closed position.

3. The retractable screen assembly according to claim 1, wherein said first brake assembly is an upper brake assembly and said second brake assembly is a lower brake assembly.

4. The retractable screen assembly according to claim 3, wherein said first brake assembly and said second brake assembly are each mounted so that said first brake assembly and said second brake assembly are displaceable in a vertical direction to engage and disengage said first guide track and said second guide track, respectively.

5. The retractable screen assembly according to claim 4, wherein said first brake assembly and said second brake assembly include a first support and a second support, respectively, which are mounted on said displaceable handle post, and a first brake engaging member that is mounted on said first support and a second brake engaging member that is mounted on said second support such that said first brake engaging member and said second brake engaging member are displaced relative to said first support and said second support, respectively, by a sliding displacement, and said first brake engaging member is operatively coupled to an associated first brake rod and said second brake engaging member is operatively coupled to an associated second brake rod, wherein said first brake engaging member comprises a first shank and said second brake engaging member comprises a second shank, and operative engagement formations disposed proximate to one end of said first shank and said second shank.

6. The retractable screen assembly according to claim 5, wherein said support includes a passage defined therein and said shank may be received at least partly within said passage and capable of sliding movement within said passage to displace said operative engagement formation into braking engagement and disengagement with an associated guide track.

7. The retractable screen assembly according to claim 5, wherein each said first brake assembly biasing arrangement and said second brake assembly biasing arrangement include a spring mounted on said support that resiliently biases an associated brake engaging member into engagement with an associated guide track, and each said spring is compressed having one end urging against said support and the other end urging against said brake engaging member.

8. The retractable screen assembly according to claim 5, wherein the operative engagement formation on said first brake engaging member has a configuration that complements a part of the respective upper and lower tracks with which it engages and, optionally, the operative engagement formations have a V-shaped cross sectional profile for engaging a complementary wedge shaped profile on said upper guide track and said lower guide track.

9. The retractable screen assembly according to claim 5, wherein said single brake control includes a pivot member that is pivotally mounted to said displaceable handle post having one portion operatively coupled to said first brake rod that is upwardly extending on one side of said pivotal member, and another portion operatively coupled to said second brake rod that is downwardly extending on another side of said pivotal member.

10. The retractable screen assembly according to claim 9, wherein said pivot member is directly coupled to said upwardly extending first brake rod and said downwardly extending second brake rod so that rotation of said pivot member in one direction acts to displace said upwardly extending first brake rod and said downwardly extending second brake rod to move said operative engagement formations away from, and to disengage from, said first guide track and said second guide track to release said brake arrangement.

11. The retractable screen assembly according to claim 10, wherein said single brake control further includes a control biasing arrangement that biases said pivot member from rotating in a first direction so that said operative engagement formations are urged into engagement with said first guide track and said second guide track.

12. The retractable screen assembly according to claim 11, wherein said control biasing arrangement comprises a spring.

13. The retractable screen assembly according to claim 12, wherein said spring is a torsion spring acting between said displaceable handle post and said upwardly extending first brake rod and said downwardly extending second brake rod.

14. The retractable screen assembly according to claim 13, wherein said single brake control further includes a handle for rotating said pivot member and which can be manually rotated in one direction to overcome a biasing force generated by said control biasing arrangement to release said displaceable handle post, and wherein said handle is automatically rotated in an opposite direction by said torsion spring when said handle is released to automatically brake said displaceable handle post.

15. The retractable screen assembly according to claim 1, wherein said flexible sheet is a mesh sheet and both said upper guide track and said lower guide track include mesh sheet receiving channels for receiving edges of said mesh sheet therein, wherein said mesh sheet receiving channels have return walls located at an upper end and a lower end of said mesh sheet receiving channels, and an opening intermediate to said upper end and said lower end of said mesh sheet receiving channels.

16. The retractable screen assembly according to claim 1, wherein said flexible sheet extends substantially a full length of said displaceable handle post and extends across and fills in a space defined between said upper guide track and said lower guide track, said fixed screen post and said displaceable handle post.

17. The retractable screen assembly according to claim 15, wherein an upper edge region and a lower edge region of said edges of said mesh sheet have stiffened ribs that run along a length of said upper edge region and said lower edge region which are received within said mesh sheet receiving channel which resists said mesh sheet from being pulled from said mesh sheet receiving channels, and wherein said stiffened ribs have a width of 1 to 3 cm and said width is substantially consistent along a length of said stiffened ribs, which extends substantially the full length of said mesh sheet, and wherein said stiffened ribs comprise a strip of plastic material that has a section that is folded over an edge of said mesh sheet which is welded to said edges of said mesh sheet.

18. The retractable screen assembly according to claim 15, wherein said mesh sheet has mesh openings having a mesh size of 1.8 mm and said mesh sheet is made of strands of fiberglass or nylon.

19. The retractable screen assembly according to claim 1, wherein said flexible sheet is a flexible mesh having a stiffened upper edge region and a stiffened lower edge region said upper guide track includes an elongate channel within which said stiffened upper edge region of said mesh sheet is received; and said second guide track includes an elongate channel within which said stiffened lower edge region of said mesh sheet is received.

* * * * *